US009574406B2

(12) United States Patent
Davis et al.

(10) Patent No.: US 9,574,406 B2
(45) Date of Patent: Feb. 21, 2017

(54) WELLBORE COMPLETION SYSTEM WITH REAMING TOOL

(75) Inventors: Lance S. Davis, Aberdeen (GB); Edward D. Scott, Cardenden (GB); Mark W. Presslie, Aberdeenshire (GB)

(73) Assignee: Deep Casing Tools, Ltd., Aberdeen (GB)

( * ) Notice: Subject to any disclaimer, the term of this patent is extended or adjusted under 35 U.S.C. 154(b) by 1231 days.

(21) Appl. No.: 13/449,398

(22) Filed: Apr. 18, 2012

(65) Prior Publication Data

US 2012/0199398 A1 Aug. 9, 2012

Related U.S. Application Data

(63) Continuation-in-part of application No. PCT/GB2010/001938, filed on Oct. 20, 2010.

(51) Int. Cl.
*E21B 10/23* (2006.01)
*E21B 10/26* (2006.01)
(Continued)

(52) U.S. Cl.
CPC ..... *E21B 10/26* (2013.01); *E21B 7/20* (2013.01); *E21B 7/203* (2013.01); *E21B 10/322* (2013.01); *E21B 17/14* (2013.01); *E21B 21/12* (2013.01)

(58) Field of Classification Search
CPC ..... E21B 4/02; E21B 10/26; E21B 10/32; E21B 10/322; E21B 23/04; E21B 33/1295; E21B 34/10
See application file for complete search history.

(56) References Cited

U.S. PATENT DOCUMENTS 5,186,265 A 2/1993 Henson et al.
5,351,758 A 10/1994 Henderson
(Continued)

FOREIGN PATENT DOCUMENTS

EP 0697501 A1 8/1995
EP 0713951 A1 5/1996
(Continued)

OTHER PUBLICATIONS

International Search Report and Written Opinion, International Application No. PCT/GB2013/050983.
(Continued)

*Primary Examiner* — Elizabeth Gitlin
(74) *Attorney, Agent, or Firm* — Richard A. Fagin

(57) ABSTRACT

A completion system comprises tubular components coupled together to form a completion string. In-flow control devices are provided to permit selective fluid communication between an internal bore of the completion string and the annulus. A reaming tool is provided at a leading end of the completion string and the reaming tool is run into the borehole with the completion string. The reaming tool comprises a fluid-powered drive unit, a reaming body and a reaming nose. In use, the completion string is located in the borehole and fluid is directed to the reaming tool to facilitate reaming of the borehole. A second tubular in the form of a washpipe may extend through an internal bore of the completion string for providing fluid to the reaming tool. The reaming tool is operable at a fluid pressure below a pressure which would activate the in-flow control devices.

21 Claims, 16 Drawing Sheets

(51) Int. Cl.

| | |
|---|---|
| ***E21B 7/20*** | (2006.01) |
| ***E21B 10/32*** | (2006.01) |
| ***E21B 21/12*** | (2006.01) |
| ***E21B 17/14*** | (2006.01) |

(56) References Cited

U.S. PATENT DOCUMENTS

| | | | | |
|---|---|---|---|---|
| 5,472,057 | A | 12/1995 | Winfree | |
| 6,062,326 | A | 5/2000 | Strong et al. | |
| 6,173,771 | B1 * | 1/2001 | Eslinger | E21B 37/04 166/173 |
| 6,213,229 | B1 | 4/2001 | Majkovic | |
| 6,520,271 | B1 * | 2/2003 | Martini | 175/21 |
| 6,659,173 | B2 | 12/2003 | Kirk et al. | |
| 6,983,811 | B2 | 1/2006 | Wardley | |
| 2004/0060710 | A1 | 4/2004 | Marshall | |
| 2007/0095573 | A1 | 5/2007 | Telfer | |
| 2010/0032170 | A1 | 2/2010 | Howett et al. | |
| 2010/0065282 | A1 | 3/2010 | Clark et al. | |

FOREIGN PATENT DOCUMENTS

| | | | |
|---|---|---|---|
| EP | 0770759 | A1 | 5/1997 |
| GB | 2462306 | A1 | 2/2010 |
| WO | 2007094900 | A1 | 1/2007 |
| WO | 2008015402 | A2 | 2/2008 |
| WO | 2008043985 | A2 | 4/2008 |
| WO | 2009066097 | A1 | 5/2009 |
| WO | 2009156376 | A1 | 6/2009 |
| WO | 2009156739 | A1 | 6/2009 |
| WO | 2011048368 | A2 | 4/2011 |

OTHER PUBLICATIONS

International Search Report, International Application PCT/GB2010/001938.

* cited by examiner

WELLBORE COMPLETION SYSTEM WITH REAMING TOOL

CROSS-REFERENCE TO RELATED APPLICATIONS

This is a continuation in part of International Application No. PCT/GB2010/001938 filed on Oct. 20, 2010. Priority is claimed from British Patent Application No. GB0918358.3 filed on Oct. 20, 2009.

STATEMENT REGARDING FEDERALLY SPONSORED RESEARCH OR DEVELOPMENT

Not applicable.

BACKGROUND

This disclosure relates to wellbore completion and, in particular, but not exclusively, to methods and apparatus for running a completion string having a reaming tool into a pre-drilled well bore tool into a pre-drilled well bore. This disclosure also relates to a reaming tool having a specific geometric design within the reaming structure.

In the oil & gas exploration and production industry, in order to access hydrocarbons from a formation, a wellbore is typically drilled from surface and the wellbore lined with sections of metal tubulars. Many forms of tubulars may be used to line the wellbore including, for example plain solid walled tubulars, slotted tubular or tubulars comprising mesh screens and the like. Each tubular section is generally provided with threaded connectors, or otherwise joined, so that a number of the tubular sections can be joined together to form a string which is run into the wellbore.

A number of pipe "strings", generally known as casing strings, may be inserted into the wellbore and suspended from the surface. The last casing string located in the wellbore which completes the wellbore may be known as the "completion string" and in contrast to the casing strings which are typically suspended from surface, the completion string may be suspended from within a selected position in the immediately previous casing string Following location of the completion string in the wellbore, the wellbore wall may be supported on, or collapse against, the outer surface of the completion string. The completion string may also be secured and sealed in place within the wellbore. For example, in the case of solid-walled tubulars, the annular space between the outer surface of the tubulars and the wellbore wall may be filled with a settable material such as cement and the completion string and cement may subsequently be perforated to provide hydraulic communication to the formation. In other examples, in the case of slotted tubulars or tubulars comprising screens, the annular space may be filled with gravel, sand or the like.

There are a number of difficulties associated with running a completion string into a wellbore and it is not unusual for the completion string not to reach the target depth on the first attempt to place it therein. For example, it is common for the completion string to encounter obstructions such as drill cuttings, ledges, swelling formations, wellbore collapses and the like which can make advancement of the casing or completion string more difficult or impossible. In other cases, the casing or completion string may become lodged or stuck in the wellbore, thereby preventing the casing or completion string from being easily retrieved or re-orientated.

Where difficulties in locating the casing or completion string proximate the target depth are encountered, if possible, the string may be withdrawn and/or the wellbore re-drilled or cleaned to remove obstructions. However, this is not always possible and, in such cases, the casing or string may be left in situ. Resolving such problems can be expensive and time-consuming. A reaming tool may be provided on the casing or completion string and the reaming tool may be rotated with the string to remove obstructions from the wellbore and permit progression of the string. However, completion strings are often not suited to transferring torque. For example, in order to improve flow of hydrocarbons through the completed string, it is desirable that the tubulars making up the string be as large a diameter as possible and the string may comprise expandable tubulars which are run into a wellbore and then plastically expanded to a larger diameter. However, larger diameter completion string tubulars typically have low torque capacity threads which are not suited to transfer of torque.

Completion strings are also being run into long horizontal or deviated wellbores in which, for example, the completion string must be advanced through a close fitting wellbore defining a highly tortuous path over several kilometers. As such, it may be very difficult to rotate the string due to friction losses. Also, the primary driving force used to locate the completion string at the target depth is often the weight of the string such that for long horizontal or deviated boreholes, the driving force to locate the completion string at target depth is provided by the weight of only a relatively short section of the string. Thus, in some cases, it may be difficult or impossible to either manipulate or locate the completion string.

Furthermore, completion strings are becoming more complex, having a elements directed to achieving a variety of functions in the wellbore. For example, a completion string may comprise a number of high cost elements, including slotted tubulars, expandable tubulars, self expanding elastomeric packers, sand screens, flow control devices, valves, and the like, many of which are inherently not suited to withstanding high levels of torque. This inhibits the ability and the desirability of transferring torque, tension or compression forces via the completion string.

Moreover, the application and location of flow control devices, valves, hydraulic liner hangers and the like are often dictated by the predicted reservoir performance calculated on the basis that the completion string is placed at the correct depth and in working condition. Thus, landing the completion string at the correct depth and in undamaged condition can be of critical importance to the utility of the well.

The completion string can thus be considered as a large diameter lightweight tubular which, in light of its vulnerability to high levels of vibration, torque and mechanical loads, is ideally placed in the wellbore without rotation.

International Patent Application Publication No. WO 2008/015402, incorporated herein in its entirety by reference describes running a string into a borehole. A reaming tool may be located on a distal end of the string, the reaming tool having a drive unit permitting a reaming structure of the reaming tool to be rotated relative to the string to facilitate reaming of the borehole without the requirement to rotate the string by application of torque thereto. The reaming tool drive unit may be powered by fluid, such as drilling mud or the like, and the fluid may be directed to the reaming tool from surface via the internal bore of the string. Such reaming tool may overcome many of the problems associated with running and operating a reaming tool with a string. However, with complex completion strings comprising tools such as sand screens, meshes, slotted liner and the like, such tools are typically porous or fluid-permeable which limits or prevents transfer of fluid through the completion string.

There is a need for improved fluid flow operated reaming tools for running completion strings, particularly in highly deviated wellbores.

SUMMARY

A completion system according to one aspect comprises tubular components coupled together to form a completion string. In-flow control devices are provided to permit selective fluid communication between an internal bore of the completion string and the annulus within a borehole. A reaming tool is provided at a leading end of the completion string. The reaming tool is insertable into the borehole with the completion string. The reaming tool comprises a fluid driven turbine, a reaming body and a reaming nose. In use, the completion string is located in the borehole and fluid is directed to the reaming tool to facilitate reaming of the borehole. A second tubular in the form of a washpipe may extend through an internal bore of the completion string for providing fluid to the reaming tool where the completion string includes elements made of porous material. The reaming tool is operable at a fluid pressure below a pressure which would activate any hydraulic devices such as the in-flow control devices. The reaming tool operates in a manner such that the fluid pressure does not exceed a pressure which would activate any hydraulic devices such as the in-flow control devices.

Other aspects and advantages of a completion system with the disclosed reaming tool will be apparent from the description and claims which follow.

DETAILED DESCRIPTION

Figure 1:
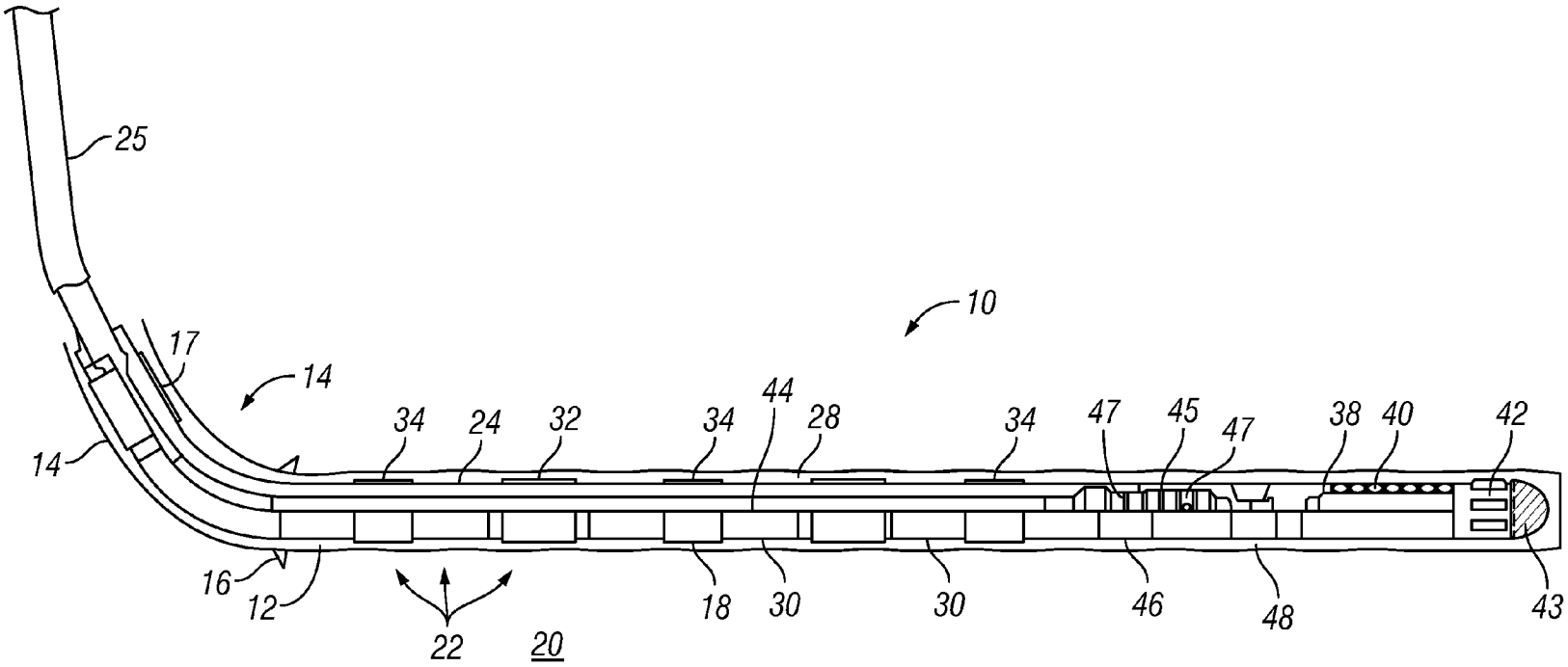
FIG. 1 is a schematic side view of a completion system according to an example embodiment.

According to a first aspect of the present disclosure there is provided a method of running a completion system into a pre-drilled borehole. The method may include coupling a fluid powered reaming tool to a completion string comprising at least one fluid pressure activated element; and powering the reaming tool using fluid supplied at a pressure below a pressure necessary to activate said at least one fluid pressure activated element.

According to another aspect there is provided a completion system comprising a fluid powered reaming tool configured for coupling to a completion string comprising at least one fluid pressure activated element, wherein the reaming tool is configured to be powered using fluid supplied at a pressure below a pressure necessary to activate said at least one fluid pressure activated element.

Accordingly, various embodiments of a reaming tool and method may permit a fluid powered reaming tool which is coupled to a completion string having a pressure activated element, such as a sandscreen, valve, in-flow control device (ICD), liner hanger or the like, to be operated at a pressure which is below that which would activate the pressure activated element.

The completion system may be configured for running into the borehole on a running string and, in particular embodiments, the running string may comprise a drill pipe string, though any suitable running or conveying member may be used. The completion system may be configured for location in the borehole substantially without rotation, thereby reducing or eliminating the risk of damaging the components of the completion system which are not suited to rotation, for example the at least one pressure activated element or the borehole, which may otherwise result if the completion string was rotated. In particular embodiments, the reaming tool may be adapted for location on a distal end of the string, though the tool may alternatively be adapted for location at another location on the string.

The reaming tool may comprise a drive unit and a reaming body, the drive unit configured to receive the fluid and thereby drive rotation of the reaming body. The drive unit may comprise a rotor and a stator, the rotor configured for rotation relative to the stator to drive rotation of the reaming body. In particular embodiments, the rotor may comprise a shaft which is mounted within a housing which defines the stator. Alternatively, the rotor may be mounted externally of the stator.

The drive unit may comprise a turbine arrangement. The turbine arrangement may be of any suitable form. For example, the turbine arrangement may comprise at least one turbine element coupled to the stator and at least one turbine element coupled to the rotor and, in use, fluid may be directed to the turbine arrangement to drive relative rotation of the rotor and stator. The turbine arrangement may be concentrically mounted about a central axis of the reaming tool, thereby facilitating low vibration rotation of the reaming tool when reaming the borehole.

The drive unit, or turbine arrangement, may be modular in construction. For example, where the drive unit comprises a turbine, the turbine elements may be provided in pairs, each pair of elements defining a power stage. In particular embodiments, one element may be adapted for coupling to the stator and a corresponding element adapted for coupling to the rotor and the turbine elements may be adapted to radially overlap. The use of a modular drive unit or turbine arrangement permits the torque output from the drive unit to be configured as required. For example, a higher number of power stages may be provided where it is known or anticipated that the reaming tool will encounter more resistance. Fewer power stages may be selected where a shorter tool is desired. A modular arrangement also permits the profile, for example the blade profile, of the reaming structure to be modified as required.

The use of a turbine may have advantages over other reaming tool rotating devices. The turbine requires low start up and/or operating differential pressure and thus may provide a higher level of safety during operation, since the pressure used to start and operate the reaming tool is below the activating pressure of the at least one pressure activated element. Where the pressure in a reservoir is low, for example due to pressure depletion, it is generally not desirable to have high fluid pressures in the borehole such that the use of a turbine according to embodiments of the present invention may facilitate reaming operations to be carried out in an environment in which reaming would otherwise be discounted. The use of a turbine which can be started and/or operated at low differential pressure may also reduce the pressure requirements of pumps and associated equipment required to deliver and/or circulate fluids in the borehole, for example, in long deviated boreholes which involve significant friction and hydraulic losses.

In addition, the use of a turbine may facilitate high speed rotation of the reaming tool relative to the completion string and may have low or negligible reactive torque in use. For example, in use, the system may be run into the bore substantially without rotation, or with a limited degree of rotation, and the reaming tool may be rotated independently of the string and at a speed that may otherwise result in damage to the tubular string or its connections. In particular embodiments, the reaming tool may be rotated at speeds of up to about 800 rpm to 1000 rpm, though the reaming tool may be adapted for higher rotational speeds, where required.

The turbine may provide the additional benefit that the turbine may define a fluid path therethrough such that, in use, fluid may be delivered through the reaming tool even in the event the turbine stalls or is otherwise rendered inoperable. While it is considered that rotation of the completion string should be minimised, the use of a turbine may also permit rotation of the reaming tool by means of string rotation should the drive unit or turbine be rendered inoperable.

The completion string may form a first tubular of the completion system and the system may further comprise a second tubular extending substantially parallel to the first tubular for delivering motive fluid to the reaming tool. The second tubular may be of any suitable form. For example, the second tubular may comprise a concentric string and, in particular embodiments, the second tubular may comprise a washpipe, hose or the like.

At least part of the second tubular may be configured for location within the completion string and so may be of smaller outer diameter than the internal diameter of the string. Alternatively, or in addition, at least part of the second tubular may be adapted for location externally of the completion string. By delivering fluid to the reaming tool via the second tubular, the reaming tool may be operated as required.

The at least one pressure activated element may be of any suitable form. For example, the at least one pressure activated element may be configurable to selectively permit fluid therethrough. In particular embodiments, the or each pressure activated element may be selected from the group consisting of: a valve, fluid control device, inflow control device (ICD), sand screen or the like.

By delivering fluid to the reaming tool via the second tubular, the reaming tool may be operated regardless of whether the pressure activated element is configured in an open position or a closed position.

In some configurations, the system may be configured so that fluid can be directed both via the second tubular and via the string and this may be used, for example, to circulate different fluids through an open element, such as an open ICD, independently of the fluid delivered to the reaming tool.

The at least one pressure activated element may further comprise a barrier member, such as a water or hydrocarbon soluble filler material, which can later dissolve when hydrocarbons are encountered, or dissolve in water or oil after a given period. Alternatively, or in addition, the barrier member may comprise a mechanical element such as a valve member, flapper, gate or the like.

The reaming tool may further comprise at least one bearing and the bearing may, for example, be adapted for location between the drive unit and the reaming body. In particular embodiments, a plurality of bearings may be provided and the bearings may be configured for modular construction. For example, one or more of the bearings may comprise an outer race mountable to one of the stator and the rotor and an inner race mountable to the other of the stator and the rotor. The provision of a modular bearing may also permit the number and/or dimensions of the bearing to be selected, as required.

The at least one bearing may be of any suitable form. The tool may comprise a combined axial and radial bearing and, in particular embodiments, the at least one bearing may comprise at least one ball bearing. Where the bearing comprises a ball bearing, in particular embodiments the ball bearing may comprise at least one low friction steel or ceramic ball bearing. The bearing may comprise at least one steel ball and at least one ceramic ball and the bearing may comprise alternate steel and ceramic balls. As the steel and ceramic have different coefficients of friction, the use of alternate steel and ceramic balls reduces the tendency for each ball to "climb" the adjacent ball.

Alternatively, or in addition, the at least one bearing may comprise a plain bearing, radial bearing or the like.

The reaming tool may further comprise a reaming nose forming a leading end of the reaming tool and the completion system. The nose may be integral to the reaming body. Alternatively, the nose may comprise a separate component coupled to the reaming body. In particular embodiments, the nose may comprise a concave end face and/or an eccentric end portion configured to assist in stabbing or cutting through obstructions in the wellbore without rotation, where required. In other embodiments, the nose may comprise a convex face and/or a concentric end portion.

At least one of the reaming body and the reaming nose may further comprise at least one fluid port for permitting fluid to be directed to the exterior of the reaming tool. The provision of a port may permit fluid, such as drilling fluid, mud or the like, to be directed through the reaming tool to assist in the removal and/or displacement of obstructions from the bore. At least one of the ports may be integrally formed in the reaming body or the reaming nose. Alternatively, or in addition, at least one of the ports may comprise a separate component coupled to the body or the nose. The fluid port may be constructed from any suitable material, including for example a ferrous metal, non-ferrous metal or a material such as ceramic or machinable glass. In particular embodiments, one or more of the fluid ports may be constructed from cast iron, such as spheroidal graphite cast iron. At least one of the ports may define, or provide mounting for, a nozzle. For example, the nozzle may be adapted to direct fluid from the fluid conduit out from the tool to facilitate removal of obstructions by jetting. The fluid and removed material may then be returned to surface via the annulus.

The reaming tool further comprises a reaming structure and the reaming structure may be formed in, or provided on, at least one of the reaming body and the reaming nose.

Any suitable reaming structure may be employed. For example, the reaming structure may comprise at least one of: a rib; a blade; a projection; and the like. The reaming structure may be arranged to extend radially to engage the borehole wall to facilitate reaming of the borehole. The reaming structure may extend around at least a portion of the circumference of the body and/or the nose and may extend in a spiral, helical, serpentine, or other configuration. In an alternative arrangement, the reaming structure may extend substantially axially.

The reaming structure may comprise a wear resistant surface and may, for example, comprise tungsten carbide elements, such as tungsten carbide blocks or bricks, arranged around the circumferential face of at least one of the reaming body and the reaming nose. Alternatively, or in addition, the reaming structure, or an element of the reaming structure, may comprise a coating, such as a high velocity oxy-fuel (HVOF) coating, or may have been subjected to a surface hardening treatment.

The reaming structure may further comprise an element defining a cutting or grinding surface, for example, polycrystalline diamond compact (PDC) cutters, thermally stable polycrystalline cutters, carbide particles or any other arrangement suitable for assisting in performing the reaming operation. For example, the element may comprise a ceramic insert pressed into or otherwise bonded to the reaming tool.

It has been found that a geometric reaming structure and, in particular a geometric arrangement of the elements, such as carbide particles, forming the grinding surfaces mitigates or eliminates the clogging of the reaming structure. The geometric reaming structure arrangement of the present invention contrasts with the conventional random arrangement or carbide particles known in the art, and may, for example, comprise a plurality of teeth arranged in one or a plurality of rows and in particular embodiments the teeth may be arranged in staggered rows. The teeth may be of any suitable form and, in particular embodiments, each tooth may be formed as a prism, such as a tetrahedral prism, extending radially to engage the borehole. Each tooth may define a leading point or edge which is configured to engage with the borehole first, in use.

At least one port or slot may be provided between the reaming elements, the at least one slot adapted to permit fluid, such as drilling mud or the like, therethrough to further assist in the reaming operation and/or to overcome or mitigate clogging of the tool. In particular embodiments, the fluid may be the same fluid as that used to drive the reaming tool, though any other suitable fluid may be used where appropriate.

The system may further comprise at least one of a downhole tractor and a vibration device configured to assist in running the completion system into the borehole. For example, at least one of a tractor and a vibration device may be located together with the reaming tool at a distal end of the completion string or at another location on the string to assist in locating the string at the desired depth and/or assist in pulling the completion string along the bore. This may be used, for example, in a horizontal or deviated bore where the ability to apply force to the string is otherwise limited to the weight of the vertical section of the string.

The system may further comprise at least one centraliser configured to support and/or protect the other components of the system. For example, the centraliser may be mounted to the string adjacent to the fluid-permeable member to protect the fluid-permeable member from damage. In addition to providing centralisation of the string in the borehole, the centraliser may also be configured to promote laminar flow in the annulus defined between the string and the borehole. In another configuration, the centraliser may be configured to promote turbulent flow where the conditions warrant enhanced wellbore cleaning through turbulent fluid flow.

At least part of the reaming tool may be configured to facilitate drilling through. For example, at least part of the tool may be constructed from a material which is readily drillable and may be constructed from aluminum, aluminum alloy or the like, though any suitable material may be used. Alternatively, the dimensions of the parts of the reaming tool may be selected to permit the tool to be drilled through with the minimum of effort.

The parts of the system may be constructed from any suitable material. For example, at least one of the reamer tool drive unit, reamer body, nose and centraliser may be constructed from 13% chrome steel or other suitable material.

According to another aspect, there is provided a method of running a completion system into a pre-drilled borehole. Such method may include coupling a turbine powered reaming tool to a completion string, and directing motive fluid to the turbine to power the reaming tool.

According to another aspect there is provided a completion system comprising a turbine powered reaming tool configured for coupling to a completion string, wherein the turbine is configured to receive motive fluid to power the reaming tool.

According to another aspect, there is provided a method of running a completion system into a pre-drilled borehole, including mounting a fluid driven reaming tool on a first tubular in the form of a completion string, and delivering motive fluid to the reaming tool via a second tubular extending substantially parallel to said first tubular.

Accordingly, various embodiments permit a completion string having a fluid-permeable element, such as a sand-screen, valve or the like, to be run into a borehole while still permitting a turbine powered reaming tool located distally of the fluid-permeable element to be operated.

According to another aspect there is provided a reaming tool having a geometric reaming element arrangement.

It will be recognised that any of the features described above in relation to any one of the aspects of the present invention may be used in combination with any of the features described in relation to any other of the aspects devices described in the present disclosure.

FIG. 1 shows a schematic side view of a completion system 10 according to an example embodiment. As can be observed in FIG. 1, a borehole 12 has been drilled and may be lined with bore-lining tubulars 14. The distal most bore-lining tubular 14 may comprise a liner which terminates in a shoe 16. In example shown, the liner 14 may comprise a 7⅝ inch (193.68 mm) liner, though any suitable diameter and thickness tubular may be used. The borehole 12 has subsequently been extended beyond the shoe 16, in the present example substantially horizontally, the horizontal unlined section 18 may extend through a hydrocarbon-bearing formation 20. It will be readily understood that the unlined section 18 of the borehole 12 may be of any required length, and may extend to any distance, including as much as several kilometers through the hydrocarbon formation 20.

The completion system 10 may comprise a number of tubular components 22, e.g., threadedly coupled together to form a completion string 24. In use, the completion string 24 may be inserted ("run") into an unlined section 18 of the borehole 12 using a supporting string 25. In the embodiment shown, the supporting string 25 may comprise a drill pipe string, though any suitable pipe string may be used. An upper end of the completion string 24 may then be suspended from the liner 16 using a liner hanger 17 and the support string 25 may then be withdrawn. FIG. 1 shows the completion string 24 after it has been run into the unlined section 18 of the borehole 12 and before the completion string 24 has been suspended from the liner hanger 17. The completion string 24 and its components are sized so that they can be run into the borehole 12, and an annulus 28 is defined between the outer surface of the completion string 24 and the borehole wall 12. The completion string 24 also defines an internal bore 26 for transfer of fluid or tools through the completion string 24.

In the embodiment shown in FIG. 1, the completion string 24 may comprise sections of 4½ inch (114.3 mm) outer diameter base pipe 30, though other suitable diameters and types of tubulars may be used where appropriate. In addition to the sections of base pipe 30, the completion string 24 may comprise a number of elements directed to various downhole operations. For example, swellable packers 32 may be provided at spaced locations along the length of the completion string 24. In the embodiment shown, the swellable packers 32 may comprise 5.625 inch (142.88 mm) outer diameter swelling type packers, though other suitable types and diameters of packers may be used where appropriate. In use, each swellable packer 32 swells and extends radially into sealing engagement with the borehole 12 to isolate sections of the annulus 28 and thereby prevent undesirable migration of fluid within the annulus 28.

In-flow control devices (ICDs) 34 may also be provided to permit selective fluid communication between the internal bore 26 of the completion string 24 and the annulus 28 and, in the embodiment shown, three 5.620 inch (142.75 mm) outer diameter ICDs 34 are provided on the string 24. In use, the ICDs 34 and packers 32 may be used together to control fluid flow into and out of the string 24.

One or more centralizers 36 (see FIG. 2B) may also be provided on the completion string 24 to assist in controlling the position of the completion string 24 as it is run into the borehole 12 and to assist in reducing frictional drag as the completion string 24 is run into the borehole 12. The, or each, centralizer 36 may also assist in protecting the other components of the system 10, such as the swellable packers 32 or ICDs 34, from damage as the completion string 24 is run into the borehole 12. A centralizer 36 may also be positioned adjacent to the ICD 34, wherein the centralizer 36 may be configured to promote laminar fluid flow in the annulus 28.

A reaming tool 38 may be provided at a distal leading end of the completion string 24 and the reaming tool 38 is run into the borehole 12 with the completion string 24. The reaming tool 38 in the present example comprises a fluid-powered drive unit 40, a reaming body 42 and a reaming nose 43.

In use, fluid (shown by the arrows in FIG. 2C) may be directed to the drive unit 40 of the reaming tool 38 to drive rotation of the reaming body 42 and reaming nose 43 to facilitate reaming of the borehole 12, for example where the completion string 24 encounters an obstruction which may otherwise prevent progression of the completion string 24 and to ensure the desired form of the unlined borehole section 18 when the completion string 24 is located in the borehole 12.

The system 10 may also comprise a second tubular in the form of a concentric string or washpipe 44 which extends through an internal bore 26 of the completion string 24. The washpipe 44 may comprise a series of threadedly coupled tubular sections having smaller outer diameter than the internal diameter of the completion string 24. In use, the washpipe 44 is run into the borehole 12 with the completion string 24.

The lower end of the washpipe 44 may comprise a plug 45 having one or more seals 47 mounted thereon. In use, the washpipe 44 may be coupled to a lock 46 provided in the completion string 24 via the plug 45, wherein the washpipe 44 seals against the lock 46 via the plug seal or seals 47 to prevent backflow of fluid up the internal bore 26. In the embodiment shown, the distal end of the washpipe 44 may comprise a 3.25 inch (82.55 mm) outer diameter S22 seal stack and the lock 46 may comprise a 4½ inch (114 mm) outer diameter×3¼ inch (82.55 mm) inner diameter anti hydraulic lock seal bore.

A float collar 48, such as a 4½ inch (114 mm) outer diameter "double v" float collar, may be provided between the lock 46 and the reaming tool 38. In use, the float collar 48 permits fluid flow to the reaming tool 38 while preventing backflow of fluid up the internal bore 26 of the completion string 24.

The washpipe 44 may provide drive fluid to the drive unit 40 of the reaming tool 38 in order to facilitate rotation of the reaming body 42 and reaming nose 43. Fluid may be supplied to the drive unit 40 regardless of whether or not the internal bore 26 of the completion string 24 is open to the annulus 28, for example where one or more of the ICDs 34 are configured in an open position.

In use, the completion system 10 is inserted into the borehole 12 substantially without rotation, thus reducing or eliminating the risk of damaging the components of the completion string 24 which are not suited to rotation or transfer of torque. Furthermore, reaming of the borehole 12 can be achieved even where part of the completion 10 is open to the annulus 28.

Referring now to FIGS. 2A to 2D, there is shown a reaming tool 38 according to an example embodiment. The reaming tool 38 may comprise a drive unit 40, a reaming body 42, a reaming nose 43 and a bearing section 50. The reaming tool 38 may be coupled to and may form a distal leading end of a completion system, such as the system 10 described above.

The drive unit 40 and bearing section 50 are provided within a body 52 of the reaming tool 38 and the body 52 is coupled to an end of the completion string 24 by a threaded box and pin connection 54 (FIG. 2C), though other suitable connectors may be used where appropriate.

The drive unit 40 comprises a rotor 56 and a stator 58 and, in use, the rotor 56 is configured for rotation relative to the stator 58 to drive rotation of the reaming body 42 and the nose 43. In the embodiment shown, the rotor 56 comprises a shaft 60 which is mounted within the housing 52. The housing 52 may define the stator 58. The shaft and rotor components are retained by a retaining nut 59 and the stator components are retained by a retaining nut 61. The drive unit 40 may further comprise a turbine arrangement 62 with turbine elements 62*a* coupled to the shaft 60 and turbine elements 62*b* coupled to the housing 52. In the embodiment shown, the drive unit 40 is modular, that is, the number of turbine elements 62*a*, 62*b* coupled to the rotor 56 and stator 58 can be selected as required. The use of a modular turbine arrangement 62 permits the length of the drive unit 42 to be minimised and the torque output from the drive unit 40 to be configured as required. As will be further explained with referenced to FIGS. 11 and 12, characteristics of the blades of the turbine elements may be selected to optimize fluid flow and power output of the drive unit 40 for specific purposes.

In use, fluid is directed through the turbine arrangement 62 to drive relative rotation of the turbine elements 62*a*, 62*b*. The use of a turbine may have certain advantages as contrasted with positive displacement drive units known in the art. For example, the turbine arrangement 62 can be started and operated using a low pressure differential and at a pressure which is below the pressure at which certain elements of the completion system, such as the ICDs 34 or packers 32 shown in FIG. 1, would be activated. In addition, the turbine arrangement 62 facilitates high speed rotation of the reaming body 42 and the reaming nose 43 relative to the completion string 24 and has low or negligible reactive torque in use. For example, the reaming tool 38 may be driven at a speed that is otherwise unachievable by rotation of the reaming tool by the completion string 24 or by a positive displacement motor ("PDM"). Furthermore, due to the concentric arrangement of the turbine elements 62*a*, 62*b*, in use, the turbine arrangement 62 may provide low vibration. The turbine arrangement 62 may also be suited to use in high pressure and high temperature environments such as those found in certain borehole environments.

Figure 2A:
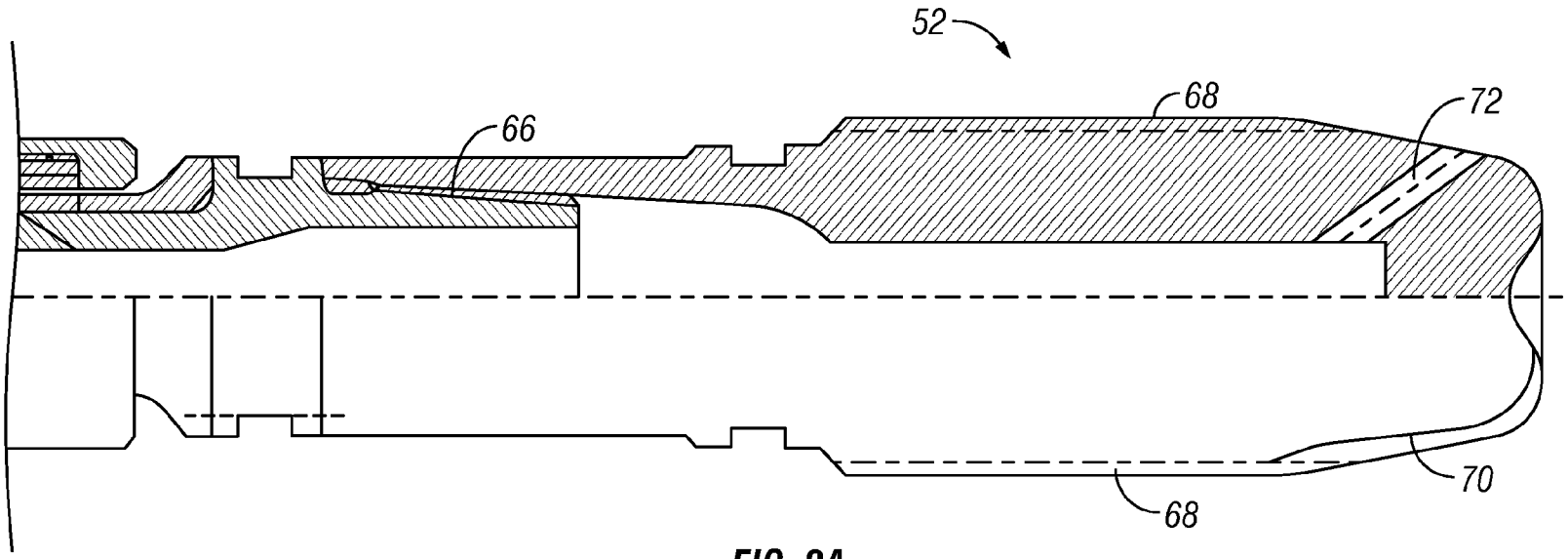
FIG. 2A is a cross sectional view of a first section of a reaming tool for use in the completion system of FIG. 1.
Figure 2B:
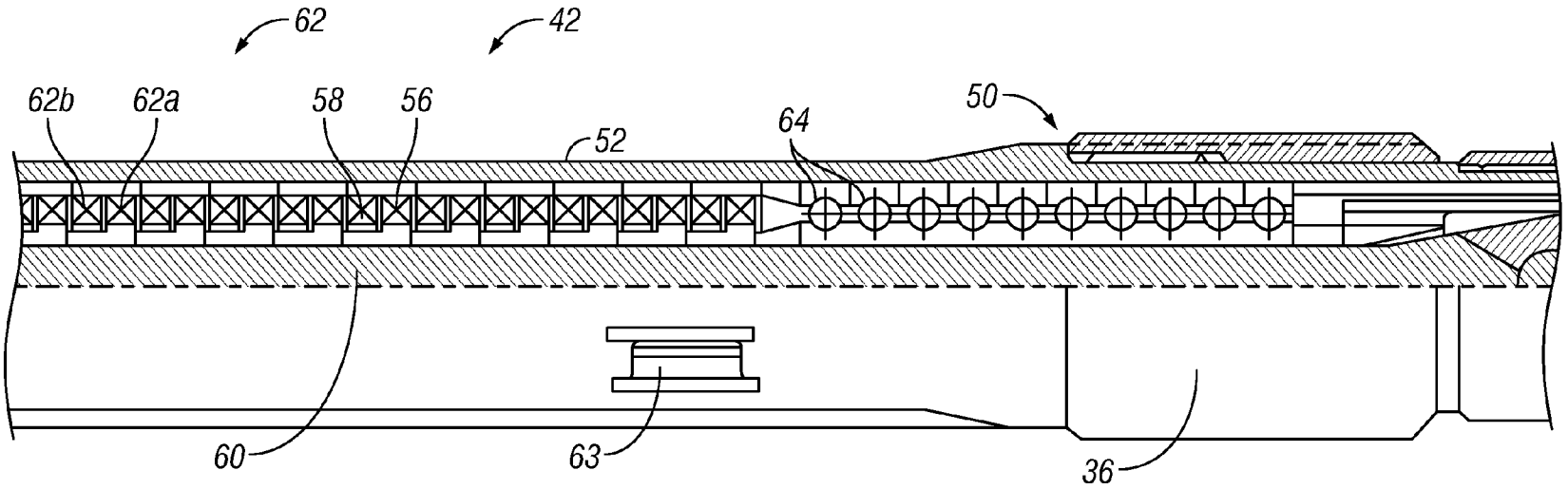
FIG. 2B is a cross sectional view of a second section of the reaming tool shown in FIG. 2A.
Figure 2C:
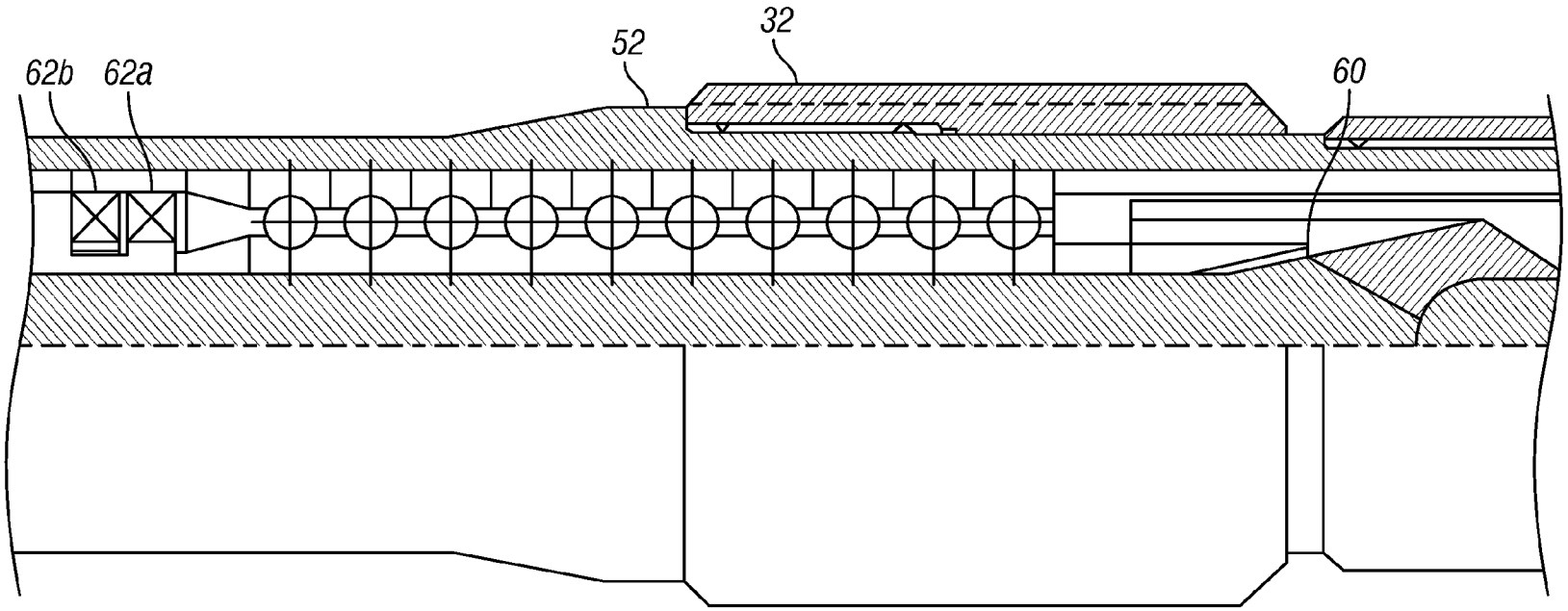
FIG. 2C is an enlarged view of part of FIG. 2B.
Figure 2D:
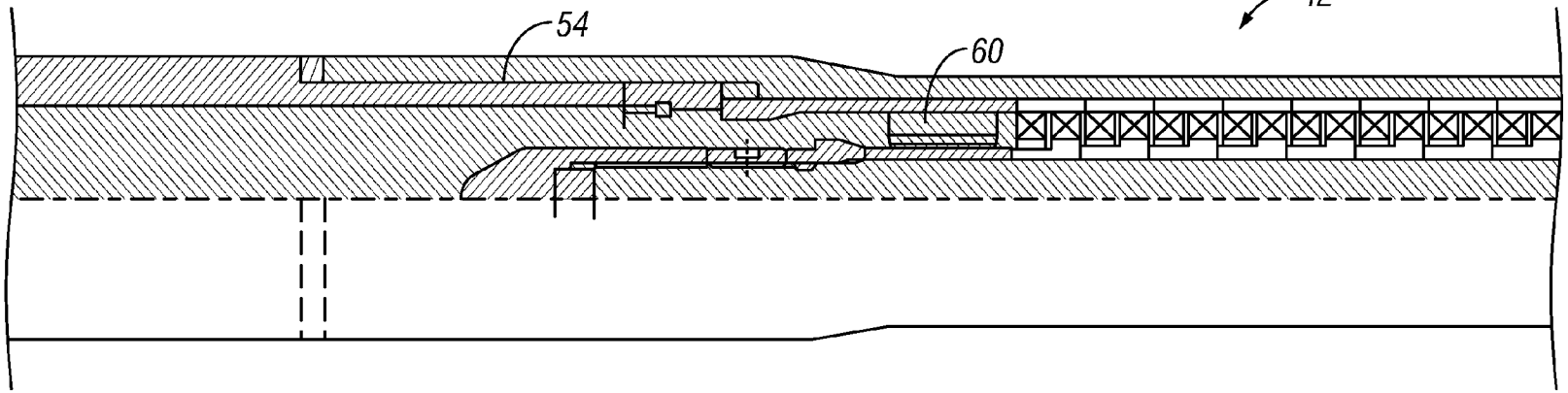
FIG. 2D is a cross sectional view of a third section of the reaming tool shown in FIGS. 2A, 2B and 2C.
Figure 2E:
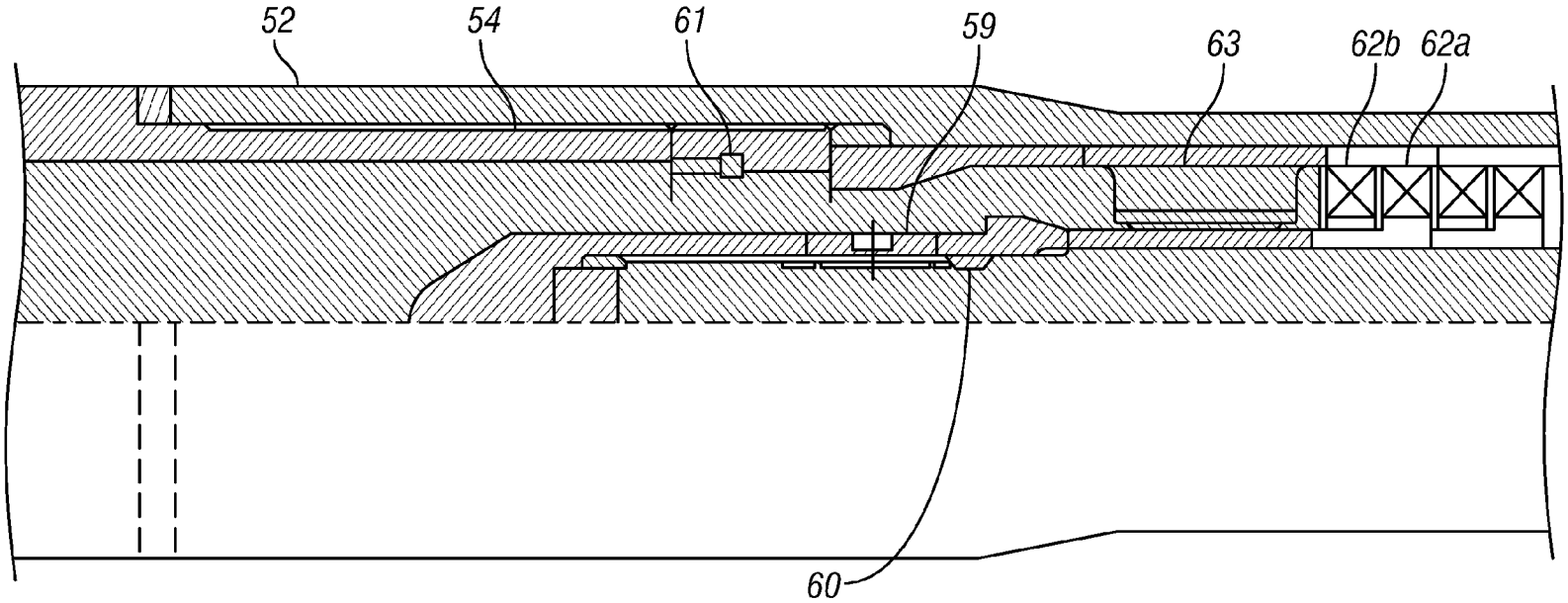
FIG. 2E is an enlarged view of part of FIG. 2D.
Figure 2F:
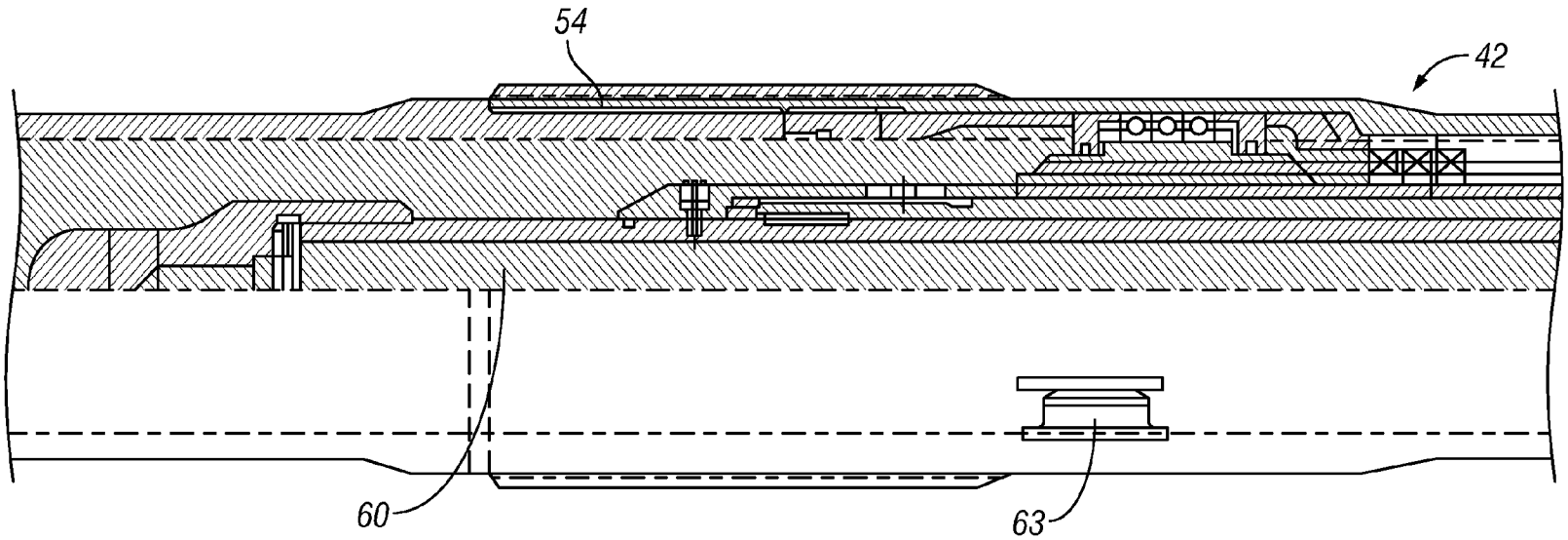
FIG. 2F is a cross sectional view of another arrangement of the third section of the reaming tool.

The reaming tool 38 may further comprise a number of bearings. In the embodiment shown in FIGS. 2A to 2D, the reaming tool 38 may comprise plain radial bearings 63 provided at either end of the turbine arrangement 62 in addition to a bearing section 50 described in more detail below. As shown in FIG. 2B, the bearing section 50 may be positioned between the drive unit 42 and the reaming body 51 and may be aligned with the turbine arrangement 62. The bearing section 50 comprises a combined axial and radial bearing including an axially extending series of low friction ball bearings 64 with alternate steel and ceramic balls. As the steel and ceramic have different coefficients of friction, the use of alternate steel and ceramic balls reduces the tendency for each ball to "climb" the adjacent ball. The bearing section 50 may be modular so that the number of bearings 64 and the overall length of the bearing section 50 can be selected, as required.

In use, fluid exiting the turbine arrangement 62 is directed through the bearing section 50 and then into the reaming nose 43.

The reaming body 42 and reaming nose 43 may be coupled to the shaft 60 of the reaming tool 38 via a threaded connection 66 and, in use, rotation of the shaft 60 drives rotation of the reaming body 42 and the reaming nose 43. In the embodiment shown, the reaming body 42 and the reaming nose 43 may have reaming structures in the form of reaming ribs 68 mounted thereon. The reaming ribs 68 extend radially from the exterior surface of the body 42 and the nose 43 and, in use, the reaming ribs 68 are arranged to perform a reaming operation on the borehole 12. In the embodiment shown, the reaming ribs 68 are integrally formed with the body 42 and the nose 52, though the reaming ribs 68 may comprise separate components, where appropriate. Any rib arrangement may be employed. By way of example, in the arrangement shown in FIG. 2A, the reaming ribs 68 are circumferentially spaced around the exterior surface of the reaming body 42 and the reaming nose 43 and may extend substantially axially.

The distal most end of the reaming nose 43 may comprise an eccentric portion 70 which can assist facilitate stabbing or cutting through obstructions in the borehole 12, where required.

One or more fluid outlets or nozzles 72 may be provided in the reaming nose 43 and, in use, fluid may be directed through such nozzle 72 to assist in removing obstructions in the borehole 12 by jetting. The fluid and removed material is then returned to surface via the annulus 28.

It has been found that the use of a geometric arrangement of carbide elements rather than the conventional random arrangement of carbide reaming elements may be particularly effective at mitigating clogging of the reaming tool 38, as can be the case with the conventional random carbide arrangement. By way of example, a reaming tool 138 having a geometric reaming element arrangement is described below with reference to FIGS. 3 to 8D.

Figure 3:
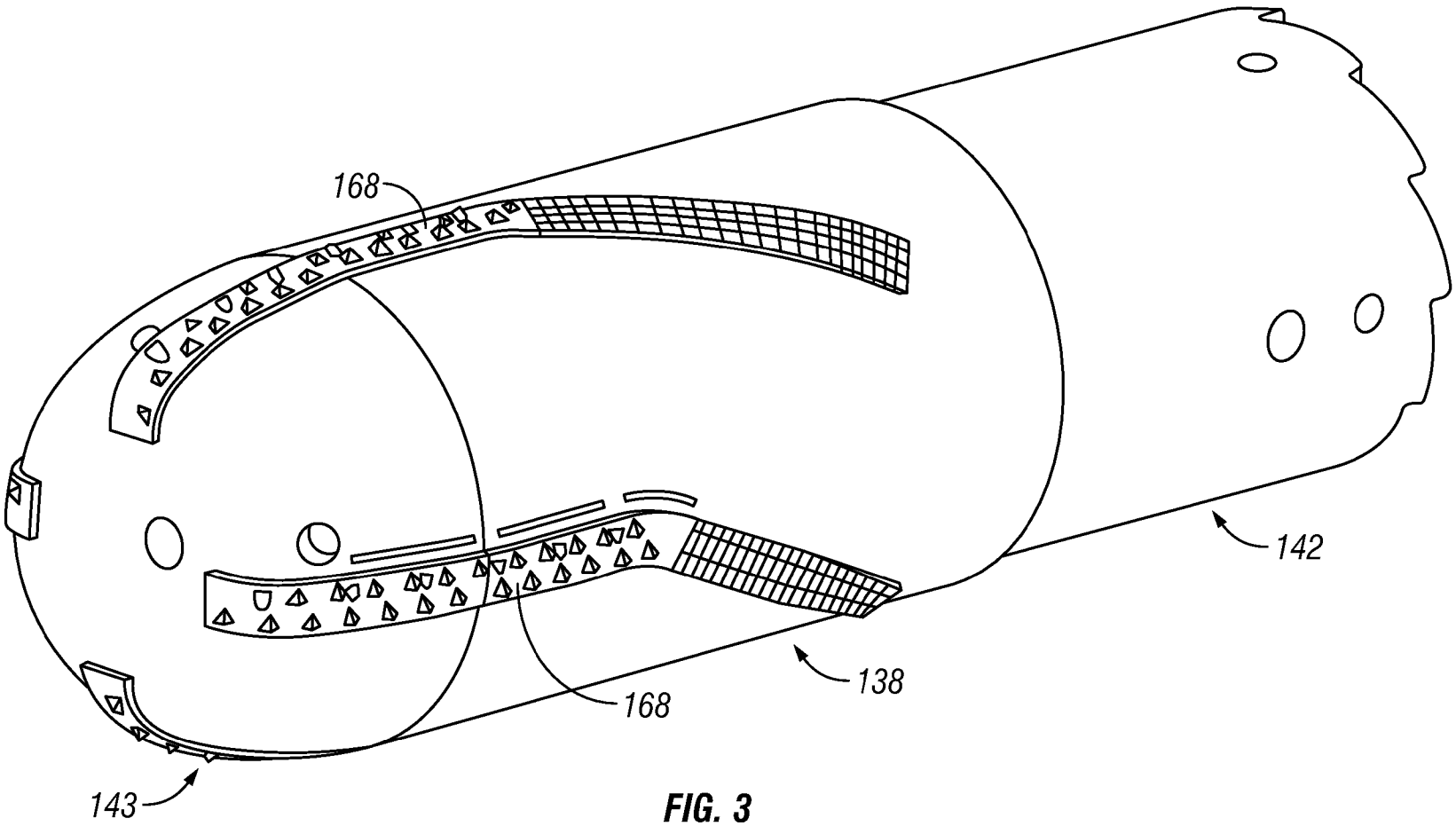
FIG. 3 is a perspective view of another example of a reaming tool.

FIG. 3 shows an example reaming tool 138 with like components to the previously described reaming tool 38 (assigned like reference numerals incremented by 100). The reaming body 142 and the reaming nose 143 of the reaming tool 138 may have reaming ribs 168 extending from their respective outer surfaces and, in use, wherein the reaming ribs 168 engage with the borehole wall 12 to facilitate grinding and/or reaming of the borehole 12.

Figure 4:
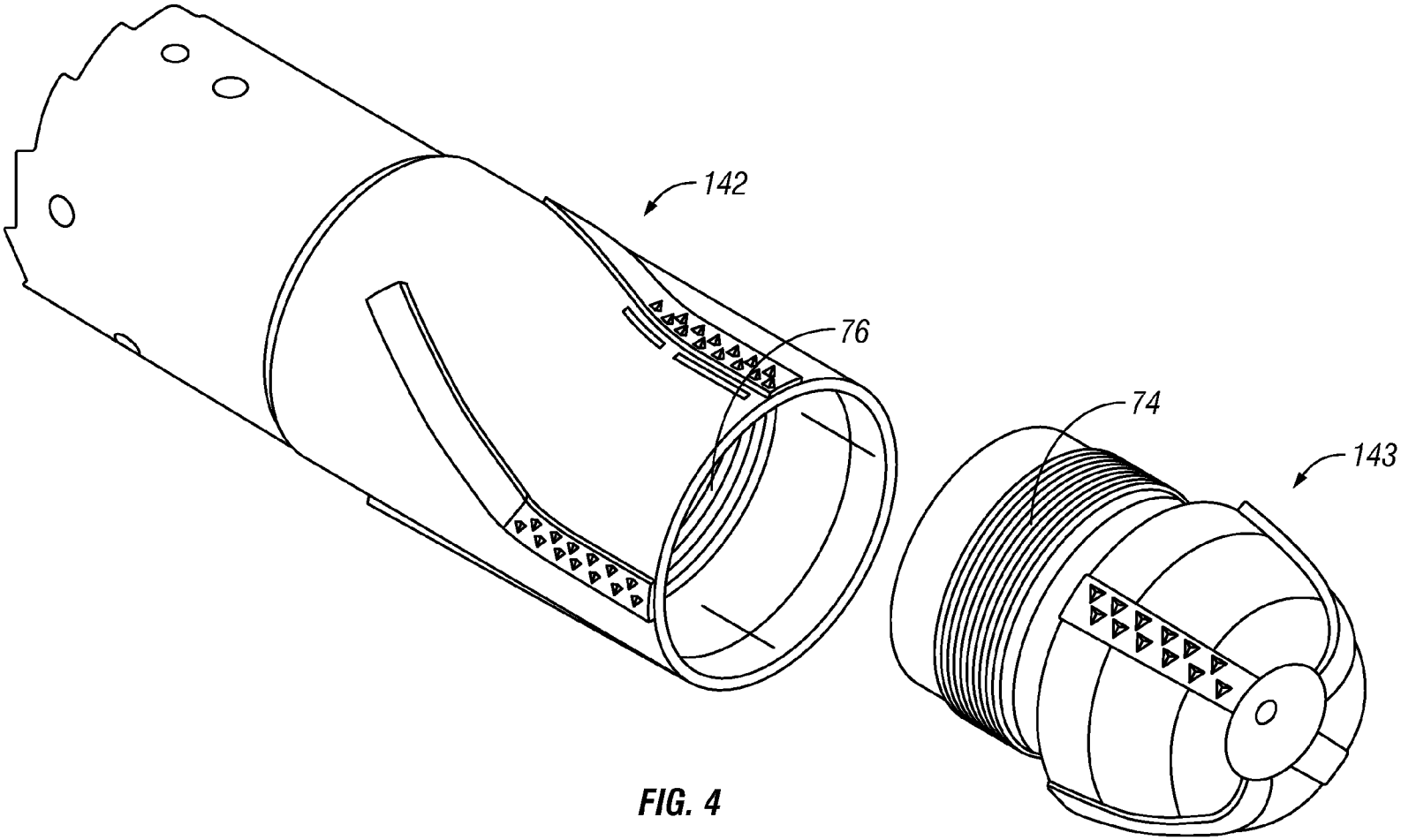
FIG. 4 is an exploded perspective view of the reaming tool shown in FIG. 3.
Figure 6:
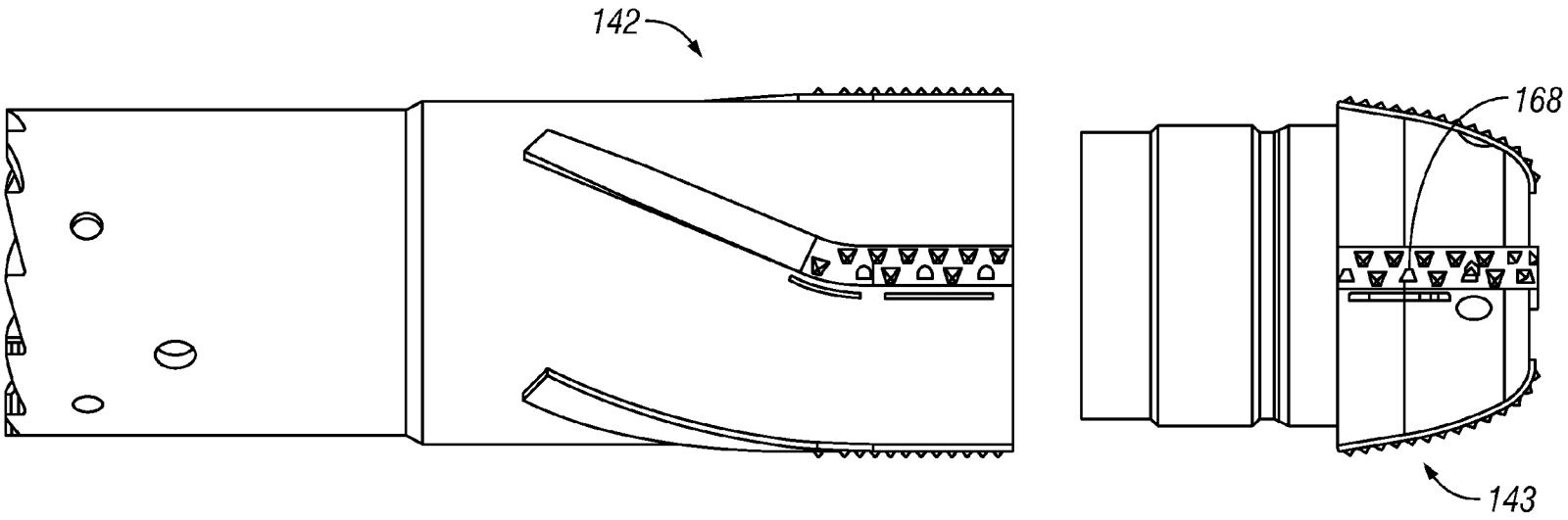
FIG. 6 is an exploded side view of the reaming tool shown in FIGS. 3 to 5.

FIGS. 4 and 6 show exploded views of the reaming tool 138. As can be observed in these figures, the reaming nose 143 may comprise a smaller diameter male threaded portion 74 which is adapted for location within the reaming tool body 142 and which is releasably secured to the reaming tool body 142 via a corresponding female threaded portion 76.

Figure 5:
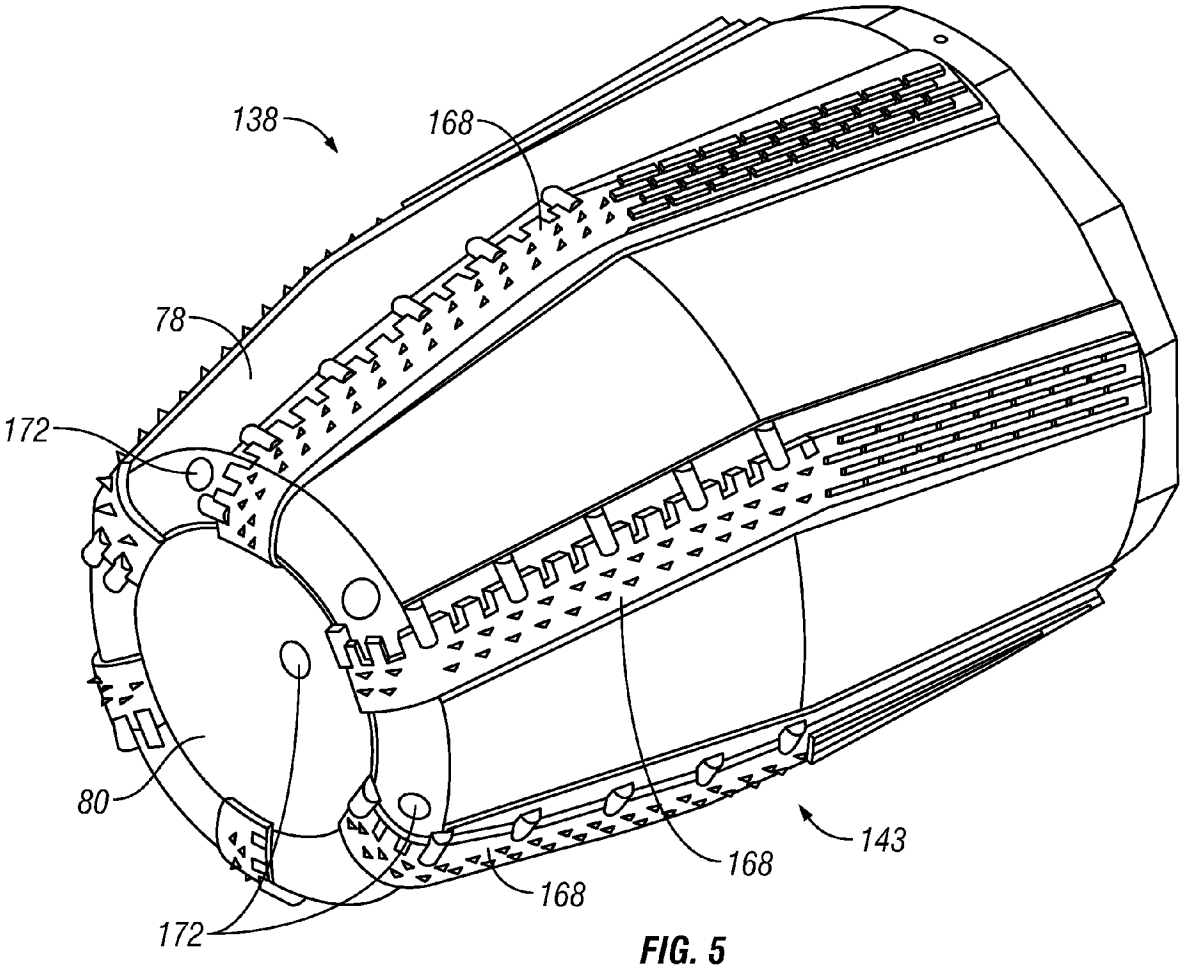
FIG. 5 is a perspective view of a nose of the reaming tool shown in FIGS. 3 and 4.

FIG. 5 shows a perspective view of the reaming nose 143 of the reaming tool 138, the nose 143 comprising a tapered front portion 78 and a concave distal end 80. The reaming ribs 168 on the nose 143 extend substantially axially along the reaming nose 143, though it will be recognised that other arrangements, such as helical or spiral configuration, may be used where appropriate. For example, in the embodiment shown, the ribs 168 on the nose 143 extend substantially axially while the ribs 168 on the reaming tool body 142 extend helically.

A number of ports may be provided in the reaming nose 143, these ports defining or providing mounting for nozzles 172. In use, fluid may be directed through the nozzles 172 to assist in reaming the borehole 12 and/or carrying reamed material back to surface.

Figure 7A:
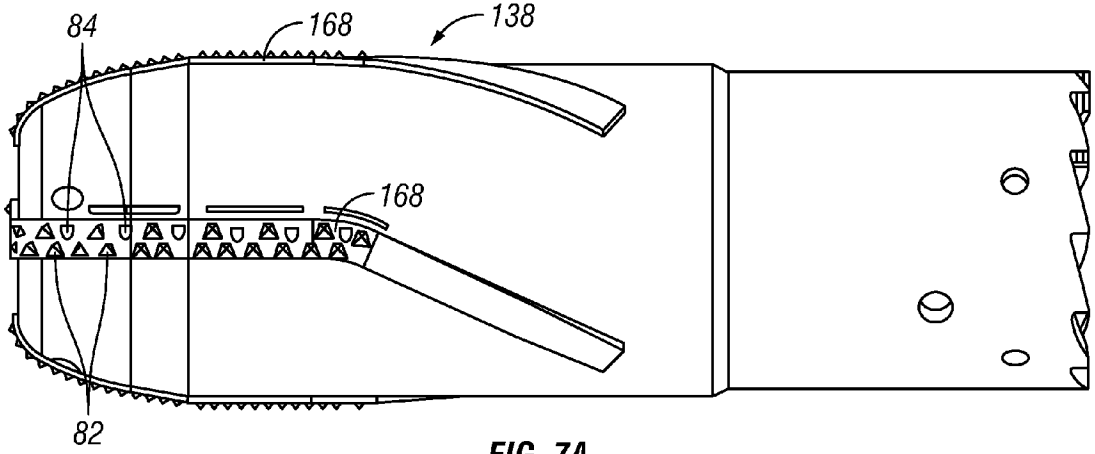
FIG. 7A is a side view of an embodiment of the reaming tool shown in FIGS. 3 to 6.
Figure 7B:
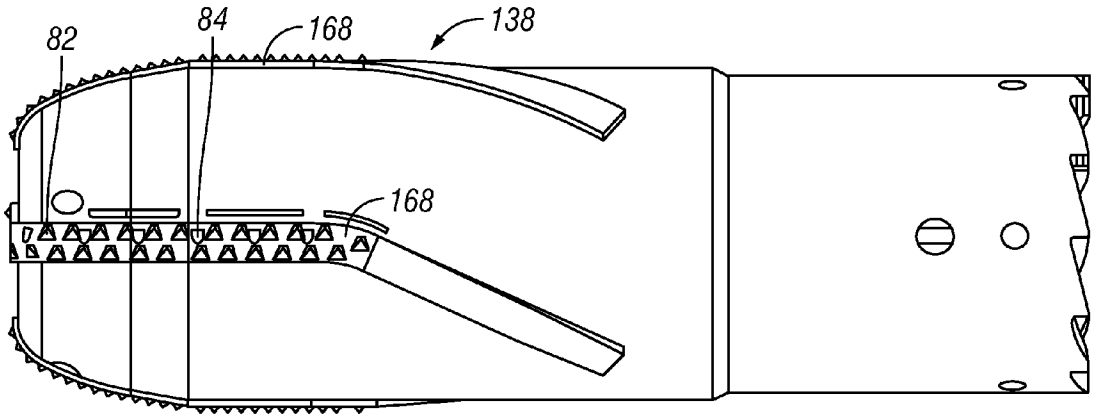
FIG. 7B is a side view of another embodiment of the reaming tool shown in FIGS. 3 to 6.
Figure 8A:
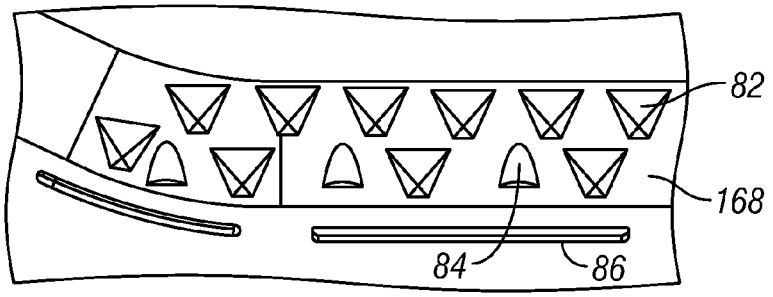
FIGS. 8A to 8D are enlarged views of cutter arrangements of the reaming tool of FIGS. 3 to 7B.
Figure 8B:
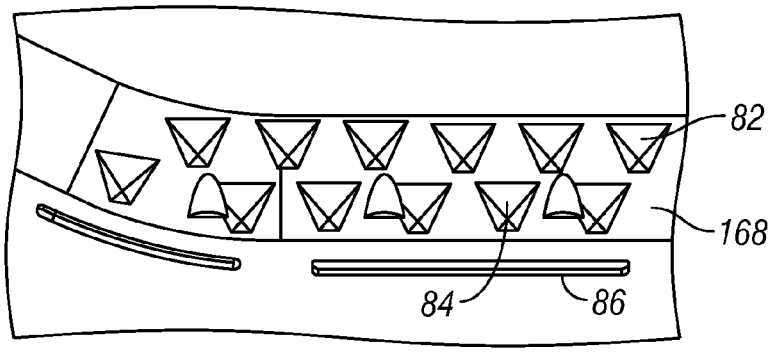
Figure 8C:
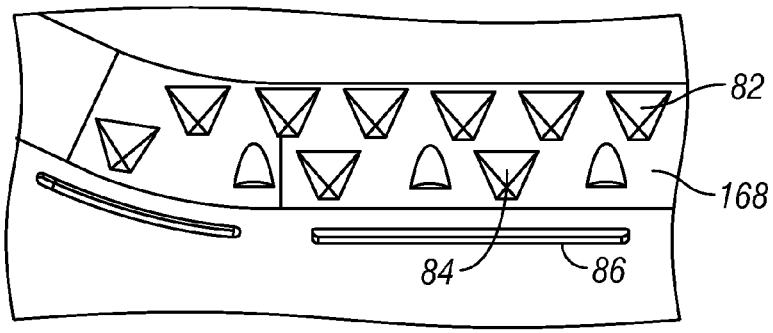
Figure 8D:
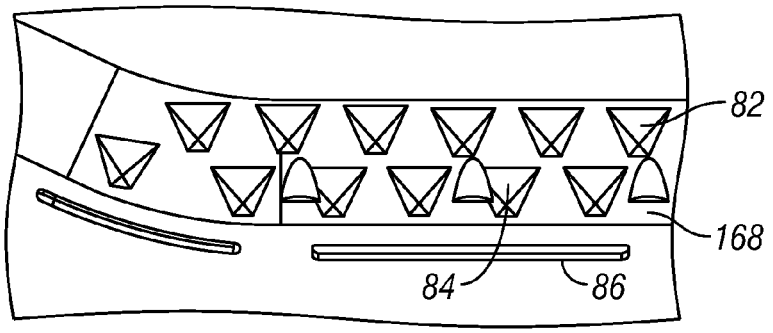
Figure 9:
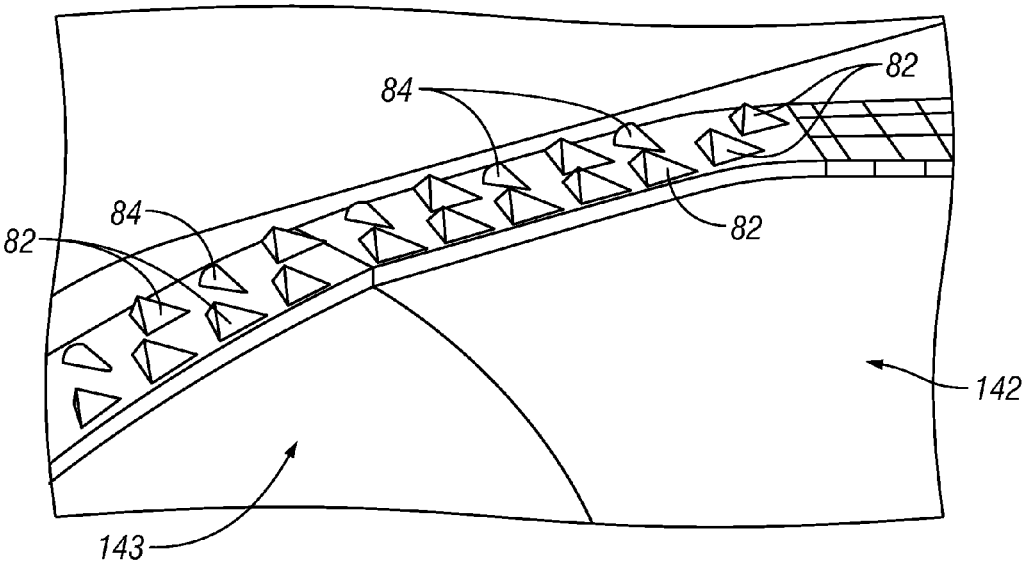
FIG. 9 is a perspective view of the geometric arrangement of FIGS. 8A to 8D.
Figure 10:
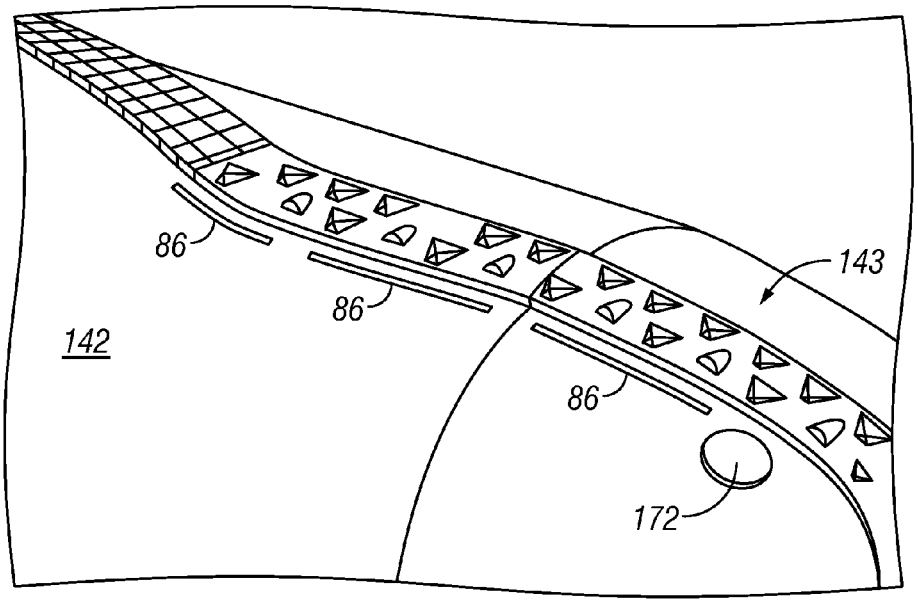
FIG. 10 is another perspective view of the geometric arrangement of FIGS. 8A to 8D.

FIGS. 7A and 7B show side views of the reaming tool 138 showing the arrangement of the reaming ribs 168. FIGS. 8A to 8D, 9 and 10 also show cutter arrangements according to other example embodiments.

As can be observed in the figures, the reaming ribs 168 comprise reaming elements or teeth 82 formed thereon. The teeth 82 may be formed into a tetrahedral prism which extends radially from the surface of the reaming rib 168 and which is adapted to ream the borehole 12. The teeth 82 are arranged in a geometric pattern and, in the embodiments shown, the teeth 82 are provided in two staggered rows along the length of the reaming ribs 168. A plurality of carbide reaming elements, known as PDCs 84 are mounted into the reaming ribs 168 in a substantially linear arrangement, and are spaced between the teeth 82. The geometric cutter arrangement of the present example contrasts with the conventional random carbide arrangement known in the art which is susceptible to clogging, reducing the ability to ream the bore.

Slots 86 (see FIGS. 7A to 8D) may also be provided about the reaming structures of the tool 38, and fluid may also be directed through the slots 86 to assist in removing reamed material by fluid jetting or the like. Additional slots (not shown) may also be provided between the reaming elements to assist or further assist in removing reamed material by fluid jetting or the like.

At least part of the system may be configured to assist in drilling through. For example, at least part of the system may be constructed from a readily drillable material, such as metal, metal alloy, aluminum or aluminum alloy, cast iron, glass, ceramic or other suitable material. In alternative embodiments, the turbine section comprise an internal diameter which is sized to permit the reaming tool to be drilled out, thereby reducing the volume of material to be removed.

Alternatively, or in addition, other devices such as a tractor and/or a vibrator could be added to the distal end of the completion string to provide a vibrator/tractor/reamer arrangement. In other configurations, a vibrator/tractor/reamer arrangement could be placed at an intermediate position on the completion string. It is within the scope of the present disclosure that commands may be sent from surface to one or more downhole devices, for example to control the on/off state of the tractor or reaming tool.

Figure 11:
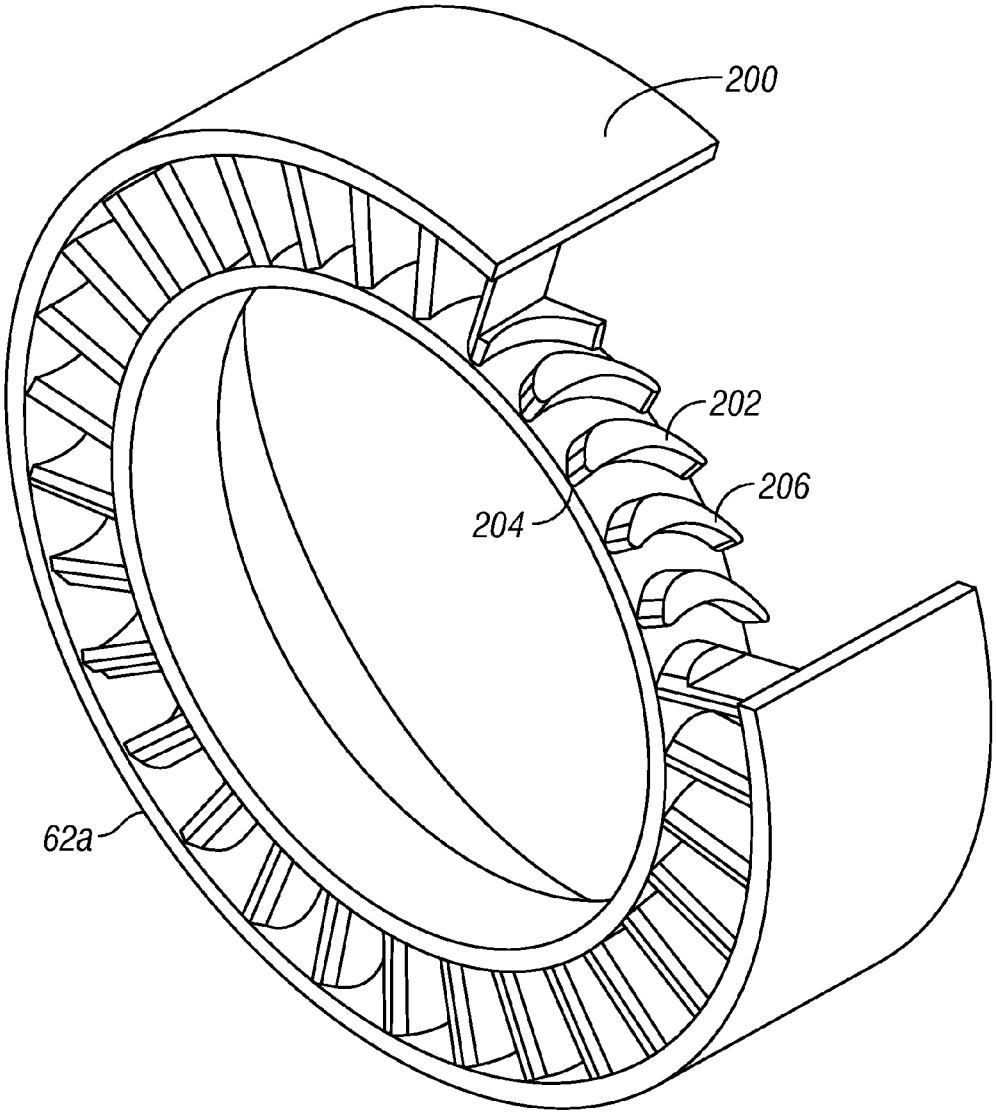
FIG. 11 shows an example of a stator element of a turbine.
Figure 12:
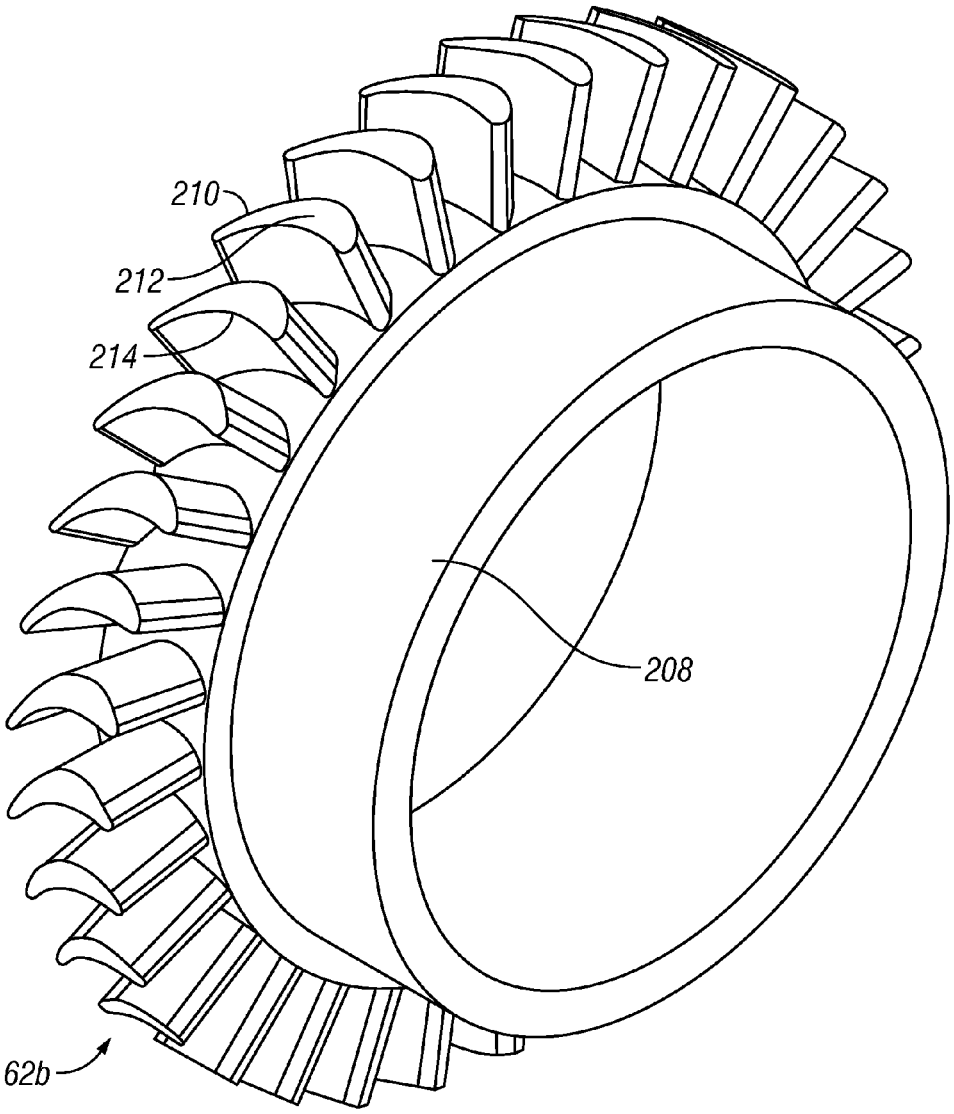
FIG. 12 shows an example of a rotor element of a turbine.

Referring to FIG. 11, one of the turbine elements 62*a* that may form part of the stator (56 in FIG. 2B) is shown in more detail. The turbine element 62*a* may include an outer ring 200 that is affixed to a plurality of circumferentially spaced apart stator blades 202. The stator blades 202 may be affixed to an inner ring 204. As explained with reference to FIG. 2B, the stator may be coupled to the housing. The blades 202 may have a curvature 204 and pitch 206 (angle with respect to a longitudinal axis of the turbine element 62*a*), a number of and a circumferential spacing between the stator blades 202 selected to result in at least one of the following. First, when fluid is pumped through the turbine arrangement (FIG. 2B) there is a minimum flow rate at which rotation of the rotor (58 in FIG. 2B) will begin. Such minimum flow rate may be related to the curvature 204, pitch 206, number of blades 202 and their circumferential spacing. The foregoing stator blade parameters may be chosen to provide a selected minimum flow rate at which rotation will commence. By having a selected minimum flow rate, it may be possible to pump fluid through the completion system (10 in FIG. 1) without causing rotation of the reaming body 42. Such pumping without causing rotation may be desirable for pumping certain types of wellbore fluids, e.g., cement, lost circulation material and the like which may be rendered less effective if mixing as a result of rotation of the reaming tool 42 takes place. Referring to FIG. 12, one of the turbine elements 62*b* forming part of the rotor (58 in FIG. 2) is shown in more detail. A plurality of circumferentially spaced apart blades 210 may be mounted to a ring 208 that may be coupled to the rotating shaft (60 in FIG. 2B). Just as with the stator turbine element 62*a* described with reference to FIG. 11, the rotor turbine element 62*b* may have blade curvature 212, pitch 210, number of blades and circumferential spacing 214 between adjacent blades selected to cause rotation of the turbine arrangement (62 in FIG. 2B) at a selected minimum flow rate. It will be appreciated by those skilled in the art that the foregoing turbine blade parameters for either or both the stator turbine elements (62*a* in FIG. 11) and the rotor turbine elements (62*b* in FIG. 12) may be selected to result in a minimum fluid flow rate at which rotation of the turbine arrangement will begin. Those skilled in the art will readily recognize the turbine elements shown at 62*a* in FIG. 11 and at 62*b* in FIG. 1 as components of a reaction turbine.

In addition to the foregoing minimum flow rate to initiate rotation of the turbine arrangement (62 in FIG. 2B), the foregoing turbine blade parameters for either or both the stator elements and the rotor elements may be selected to cause a maximum pressure drop when the reaming body (42 in FIG. 1) becomes "stalled", that is, ceases to rotate by reason of excessive load on the reaming body (42 in FIG. 1) and/or the reaming nose (43 in FIG. 1). A property of fluid driven turbines is that they present a lower pressure drop to fluid passed therethrough than when the rotor is moving as a result of fluid flow. By selecting turbine blade parameters such that the pressure drop upon stall is maximized, the risk of unintentionally activating any pressure activated components in the completion system (10 in FIG. 1) is reduced. In addition, a maximized pressure drop on stall may provide the completion system operator with a more easily recognizable signal at the surface that the reaming body has stalled, thus indicating corrective action that may be required, e.g., reducing axial loading on the reaming body and reaming nose. The foregoing turbine blade parameters may also be selected to prevent the fluid pressure from exceeding a pressure at which any one of the fluid pressure actuated devices in the completion string is activated.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A completion system comprising: a fluid powered reaction turbine coupled to a reaming tool, the reaming tool configured for coupling to a completion string insertable into a borehole, the completion string comprising at least one fluid pressure activated element, wherein the turbine is configured to be powered using fluid supplied at a pressure below an activation pressure of the at least one fluid pressure activated element, wherein the reaction turbine comprises at least one stator element and at least one rotor element, the at least one stator element and the at least one rotor element having a plurality of circumferentially spaced apart blades, a curvature, a pitch, a circumferential spacing between blades and a number of blades being such that a pressure drop across the reaction turbine when the motor is stalled is maximized, and wherein the pressure drop across the reaction turbine is smaller when the motor is stalled than when the motor is rotating.

2. The completion system of claim 1 wherein the turbine is configured to prevent the operating pressure exceeding the activation pressure of the at least one fluid pressure activated element.

3. The system of claim 1 wherein the at least one stator element and the at least one rotor element each having at least one blade wherein the curvature, the pitch, the circumferential spacing between blades and the number of blades on each of the at least one stator element and on the at least one rotor element are selected to provide a predetermined minimum fluid flow rate at which rotation of the at least one rotor element begins.

4. The system of claim 1, wherein the fluid powered turbine is concentrically mounted about a central axis of the reaming tool.

5. The system of claim 1, wherein the fluid powered turbine comprises a plurality of modules, each module comprising a rotor element and a stator element, a number of the modules selected to provide a selected pressure drop for a selected length of the fluid powered turbine.

6. The system of claim 1, further comprising a tubular insertable into an interior of the completion system for delivering the fluid to the reaming tool.

7. The system of claim 6, wherein the insertable tubular comprises a concentric pipe string.

8. The system of claim 6, wherein the insertable tubular comprises a washpipe.

9. The system of claim 1, wherein the at least one pressure activated element comprises one of a valve, a liner hanger, a fluid control device, a packer, an inflow control device (ICD), a sand screen, and a fluid-permeable member.

10. The system of claim 9, wherein the at least one pressure activated element further comprises a barrier member.

11. The system of claim 1, further comprising a reaming nose forming a leading end of the reaming tool and a reaming tool body coupled to an output of the fluid powered turbine.

12. The system of claim 11, wherein at least one of the reaming body and the reaming nose further comprises at least one fluid port for directing fluid to the exterior of the reaming tool.

13. The system of claim 11, wherein at least one of the reaming body and the reaming nose are rotationally balanced.

14. The system of claim 11, wherein the reaming tool further comprises a geometric reaming structure formed in, or provided on, at least one of the reaming body and the reaming nose.

15. The system of claim 1, further comprising at least one of: at least one downhole tractor, at least one vibration device, and a centraliser configured to assist in running the completion system into the borehole.

16. A method of running a completion system into a pre-drilled borehole, the method comprising: coupling a reaming tool rotated by a reaction turbine to a completion string, the completion string having at least one pressure activated component thereon; directing motive fluid to the reaction turbine to power the reaming tool, the motive fluid supplied at a pressure below an activation pressure of the at least one pressure activated component; and observing a fluid pressure while the reaming tool is rotating and reducing an axial loading on the reaming tool when a drop in the observed pressure takes place, wherein blades in the reaction turbine have at least one of a number thereof, a circumferential spacing therebetween, a pitch and a curvature being such that a pressure drop across the reaction turbine during when the motor is stalled is maximized and wherein the pressure drop across the reaction turbine is smaller when the motor is stalled than when the motor is rotating.

17. The method of claim 16, comprising running the completion system into the borehole substantially without rotation.

18. The method of claim 16, wherein the turbine has a selected minimum flow rate at which rotation thereof is initiated, and pumping a selected fluid through the completion string and the reaming tool without rotating the reaming tool.

19. The method of claim 18 wherein the selected fluid comprises one of cement and lost circulation material.

20. The method of claim 16 further comprising running a tubular member into the completion string and delivering the fluid to the reaming tool via the tubular member.

21. The method of claim 20 further comprising retrieving the tubular member from the borehole.

* * * * *